US006821154B1

(12) United States Patent
Canfield et al.

(10) Patent No.: US 6,821,154 B1
(45) Date of Patent: Nov. 23, 2004

(54) ELECTRICAL DEVICE CONNECTOR AND METHOD THEREFOR

(75) Inventors: David L. Canfield, Lake Hughes, CA (US); Charles L. Byers, Canyon Country, CA (US)

(73) Assignee: Alfred E. Mann Foundation for Scientific Research, Valencia, CA (US)

( * ) Notice: Subject to any disclaimer, the term of this patent is extended or adjusted under 35 U.S.C. 154(b) by 0 days.

(21) Appl. No.: 10/678,539

(22) Filed: Oct. 3, 2003

(51) Int. Cl.[7] ..... H01R 13/66; H01R 33/945
(52) U.S. Cl. ..... 439/620
(58) Field of Search ..... 439/698, 620

(56) References Cited

U.S. PATENT DOCUMENTS 6,164,284 A 12/2000 Schulman et al. ..... 128/899
6,185,452 B1 2/2001 Schulman et al. ..... 604/20
6,208,894 B1 3/2001 Schulman et al. ..... 607/2

*Primary Examiner*—Javaid H. Nasri
(74) *Attorney, Agent, or Firm*—Gary D. Schnittgrund

(57) ABSTRACT

A connector and method of making electrical connection between an electrical conductor and a removable electrical device. The connector is an elastic material, such as silicone, that is both compatible with the environment and is an electrical insulator. It forces contact between the electrical device and integral contacts in the connector by virtue of its elasticity. The electrodes and the connections are protected from the environment to avoid electrical leakage or corrosion of the electrodes.

17 Claims, 1 Drawing Sheet

ELECTRICAL DEVICE CONNECTOR AND METHOD THEREFOR

FIELD OF THE INVENTION

This invention relates to a connector for electrical devices and methods, and more particularly to connecting electrical wires to an implantable device to enable ease of connection and to minimize risk to the living tissue during and after surgery.

BACKGROUND OF THE INVENTION

Connection of electrical devices to electrical conductors is a common event, such as placing a fuse in a fuse holder. However, it is often desired to connect an electrical device in a hostile environment, such as in salt water or in living tissue. Such connections are particularly difficult to make with implantable devices in a human body, for example.

Neurological disorders are often caused by neural impulses failing to reach their natural destination in otherwise functional body systems. Local nerves and muscles may function, but, for various reasons, such as injury, stroke, or other cause, the stimulating nerve signals do not reach their natural destination. For example, paraplegic and quadriplegic animals have intact nerves connected to functioning muscles and only lack the brain-to-nerve link. Electrically stimulating the nerve or muscle can provide a useful muscle contraction.

Further, implanted devices may be sensors as well as stimulators. In either case, difficulties arise both in providing suitable, operable stimulators or sensors which are small in size and in passing sufficient energy and control information to or from the device, with or without direct connection, to satisfactorily operate them. Miniature monitoring and/or stimulating devices for implantation in a living body are disclosed in U.S. Pat. Nos. 6,164,284, 6,185,452, and 6,208,894.

It must be assured that the electrical current flow does not damage the intermediate body cells or cause undesired stimulation. Anodic or cathodic deterioration of the stimulating electrodes must not occur.

In addition, at least one small stimulator or sensor disposed at various locations within the body may send or receive signals via electrical wires. The implanted unit must be sealed to protect the internal components from the body's aggressive environment. If wires are attached to the stimulator, then these wires and the area of attachment must be electrically insulated to prevent undesired electric signals from passing to surrounding tissue.

Miniature stimulators offer the benefit of being locatable at a site within the body where a larger stimulator cannot be placed because of its size. The miniature stimulator may be placed into the body by injection. The miniature stimulator offers other improvements over larger stimulators in that they may be placed in the body with little or no negative cosmetic effect. There may be is locations where these miniature devices do not fit for which it is desired to send or receive signals. Such locations include, but are not limited to, the tip of a finger for detection of a stimulating signal or near an eyelid for stimulating blinking. In such locations, the stimulator and its associated electronics are preferably located at a distance removed from the sensing or stimulating site within the body; thus creating the need to carry electrical signals from the detection or stimulation site to the remote miniature stimulator, where the signal wire must be securely fastened to the stimulator.

Further, the miniature stimulator may contain a power supply that requires periodic charging or require replacement, such as a battery. When this is the case, the actual stimulation or detection site may be located remotely from the stimulator and may be located within the body, but removed a significant distance from the skin surface. By having the ability to locate the miniature stimulator near the skin while the stimulation site is at some distance removed from the skin, the miniature stimulator and its associated electronics can be more effectively replaced by a surgical technique or more efficiently recharged through the skin by any of several known techniques. If the electronics package is replaced surgically, then it is highly desirable to have the capability to reconnect the lead wires to the miniature stimulator via an easy, rapid and reliable method, as disclosed herein.

DETAILED DESCRIPTION OF THE PREFERRED EMBODIMENT

Figure 1:
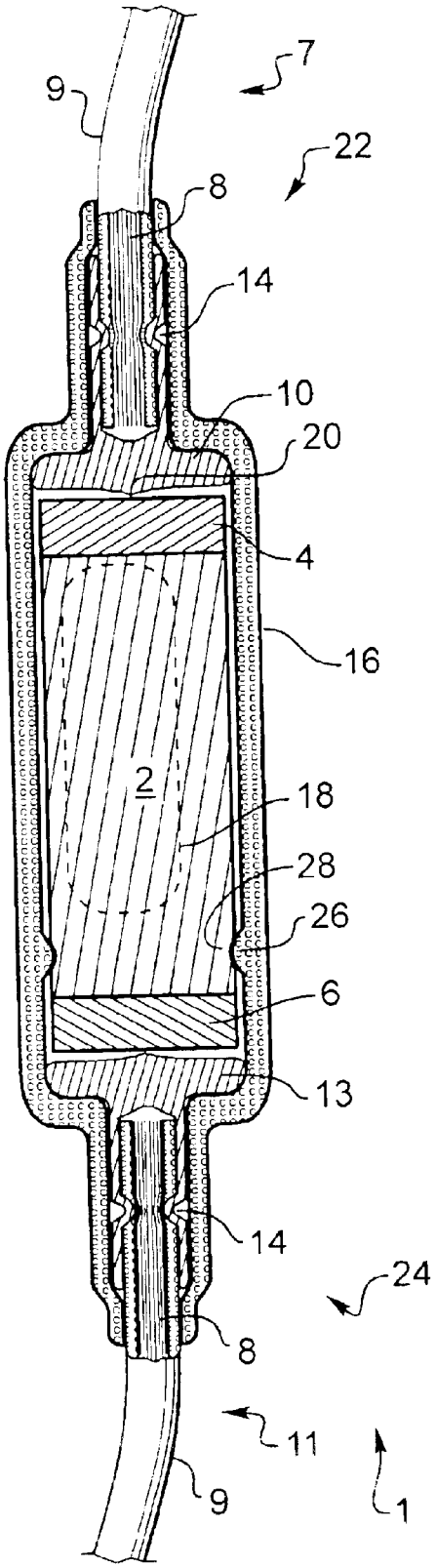
FIG. 1 illustrates a view of the implantable stimulator in cross section showing the connector.

FIG. 1 provides a cross-sectional view of a preferred embodiment of a hollow boot connector 1. The connector is comprised of an elastic casing 16, preferably silicone or another material that is chosen to be compatible with the design environment. Silicone is biocompatible and a preferred selection for applications involving implantation in living tissue. Further, the selected material is preferably an electrical insulator that minimizes leakage of electric current and that isolates the electrical device 2 from the environment.

The elastic casing 16 contains at least one insertion opening 18 that provides access through the wall of the casing 16 and into the inside of the hollow boot connector 1, where the electrical device 2 is removably inserted. It is known to the inventors and within the scope of the instant invention, but not illustrated herein, that a plurality of openings 18 may be present in elastic casing 16 such that there are, in essence, a plurality of bands or straps formed by the plurality of openings 18. The electrical device 2 may either be inserted before being placed into service, or during enablement for service, or as a replacement for a prior device during actual service. The connector 1 enables positive and rapid insertion of the electrical device 2 under difficult conditions, such as in seawater or in living tissue during surgery.

It is understood that the electrical device 2 encompasses electronic devices, electrical circuit components, conductors, sensors, and stimulators, such as, but not limited to the BION of Advanced Bionics Corporation.

The hollow boot connector 1 is further comprised of at least one electrical contact 10 that is integrally connected to an electrical conductor 7, which is preferably a wire conductor 8 surrounded by a wire insulator 9. The conductor 7 is preferably connected to the first electrical contact 10 by a known technique, such as crimping, as shown by crimping connection 14. As alternative embodiments, any of the known methods of forming a connection between a wire and a contact is applicable in lieu of crimping, as is known in the art.

The elastic casing 16 preferably fits the electrical device 2 snugly such that when the electrical device 2 is inside the hollow boot connector 1, the first electrical contact 10 is urged toward the first electrode 4 that forms part of electrical device 2 by the stretched elastic casing 16. The first electrical contact 10 preferably has a nipple contact 20 that concentrates the contact stress between contact 10 and electrode 4, thus insuring electric continuity.

Illustrated in FIG. 1 is a two-conductor connector 1, having a first end 22 with a first conductor 7 and a second end 24 having a second conductor 11 each attached to the first electrical contact 10 at the first end 22 and the second electrical contact 13 at the second end 24. In this configuration the elastic casing 16 is stretched when the electrical device 2 is inserted inside the hollow boot connector 1, which in turn urges the respective electrical contacts against the first electrode 4 and the second electrode 6.

It is preferred that the first conductor 7 be integrally bonded to the elastic casing at the first end 22 to assure that there is no leakage or failure at the first end 22 which might reduce or eliminate electrical conductivity between the first electrode 4 and the first electrical contact 10. The wire insulator 9 is preferably glued to the casing 16, although it may be thermally bonded for equal effect. It will be obvious to one skilled in the art that a similar bond may be utilized at second end 24.

To insure electrical isolation between electrodes, insertion opening 18 is positioned so that it does not expose first electrode 4 or second electrode 6 of electrical device 2 to the environment surrounding the connector 1. Further, to insure electrical isolation between electrodes, at least one sealing ridge 26 may be added, in an alternative embodiment, to the inside of elastic casing 16. The sealing ridge 26 is located between insertion opening 18 and either the first electrode 4 or second electrode 6. Obviously, multiple sealing ridges may be added to facilitate an effective seal. A further embodiment adds a seal receiver 28 to electrical device 2, which mates with sealing ridge 26 to enhance the sealing effectiveness. Further, a tie, not illustrated may be placed around the outside of the elastic casing 16 either in lieu of the sealing ridge 26 or in conjunction with it, to assure a tight seal.

Figure 2:
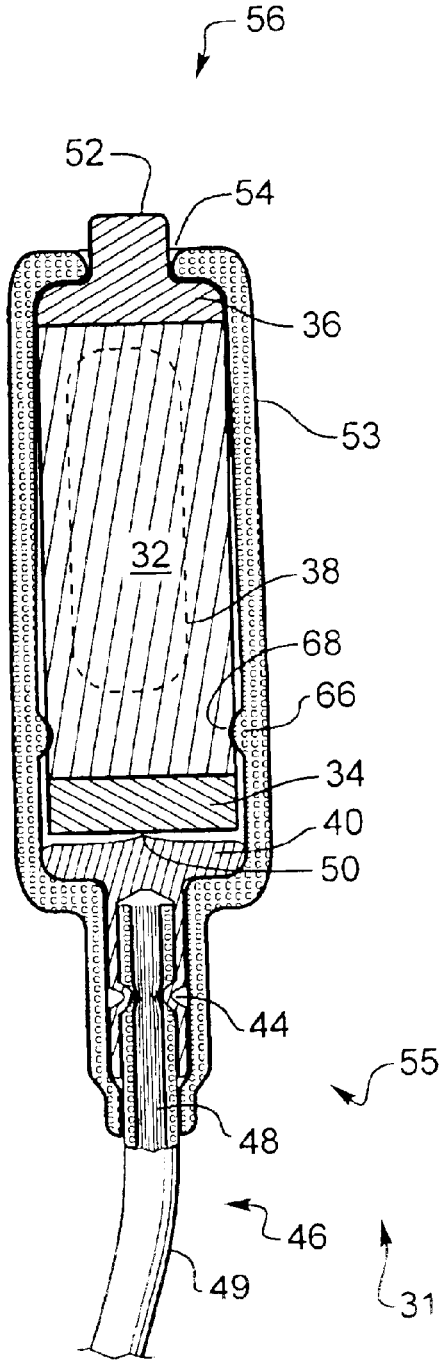
FIG. 2 schematically depicts a cross-sectional view of the stimulator showing the connector.

Illustrated in FIG. 2 is a hollow boot connector 31 having a first end 55 and a single first conductor 46 that is comprised of a wire conductor 48 with wire insulator 49. Analogous to that described previously, the elastic casing 53 has an insertion opening 38 to accept the electrical device 32 to the interior of connector 31. When the electrical device 32 is inserted therein, the elastic casing 53 is stretched such that the electrical contact 40 and its nipple contact 50 are urged into electrical contact with first electrode 34.

Analogous to the embodiment previously presented, first conductor 46 is attached to electrical contact 40 by techniques know to one skilled in the art, preferably by crimping at crimp connector 44.

In alternative embodiments, one or more sealing ridge 66 may be employed, optionally with a matching seal receiver 68 in the electrical device 32 surface to form a tight seal. Ties or compression bands (not illustrated) may be placed on the outside of connector 31 to facilitate the seal.

In this embodiment, the electrical device 32 has a second electrode 36 that is further comprised of an electrode extension 52. At least a portion of electrode extension 52 protrudes from the second end 56 of connector 31 through an aperture 54 in the elastic casing 53. It is obvious that there are many electrical devices and many electrode configurations available and which may be utilized with the hollow boot connector 31. The presented embodiments are not limiting, but are illustrative of connector 31 applications.

Obviously, many modifications and variations of the present invention are possible in light of the above teachings. It is therefore to be understood that, within the scope of the appended claims, the invention may be practiced otherwise than as specifically described.

What is claimed is:

1. A hollow connector for removably mounting an electrical device having at least a first electrode, the connector comprising:

an outer elastic casing comprised of a resilient flexible material;

said connector having a first end and a second end;

a first electrical conductor extending through said first end; and the casing defining an opening, giving access to the interior of the connector, such that when the electrical device is inserted through the opening to the interior of the connector, the casing is stretched and the first electrical conductor is thereby urged against said first electrode, providing electrical communication therebetween.

2. The hollow connector according to claim 1, wherein said electrical device comprises a second electrode and a second electrical conductor extending through the second end of said connector; and said second conductor being urged against said second electrode by said stretched casing, thereby providing electrical communication therebetween.

3. The hollow connector according to claim 2, wherein said second electrical conductor is integrally bonded to said second end.

4. The hollow connector according to claim 1, wherein said casing defines an aperture in said second end, the casing configured to prevent said electrical device from passing through the aperture, retaining said electrical device inside said connector, said electrical device having a second electrode, thereby exposing at least a portion of said second electrode to the environment outside said connector.

5. The hollow connector according to claim 1, wherein said resilient flexible material is biocompatible.

6. The hollow connector according to claim 1, wherein said resilient flexible material is comprised of silicone.

7. The hollow connector according to claim 1, wherein said first electrical conductor extending through said first and is integrally bonded thereto.

8. The hollow connector according to claim 1, wherein said connector is suitable for implantation in living tissue.

9. The hollow connector according to claim 1, wherein said connector is suitable for use in saltwater.

10. The hollow connector according to claim 1, wherein sold connector is configured to retain an electrical sensor.

11. The hollow connector according to claim 1, wherein said connector is configured to retain an electrical stimulator.

12. The hollow connector according to claim 1, wherein said casing contains at least one seal lip that mates with said electrical device to electrically isolate said first electrode.

13. The hollow connector according to claim 1, wherein said electrical device is configured to mate with a sealing ridge.

14. A method of removably anchoring an electrical conductor to an electrical device to establish electrical communication therebetween, comprising the steps of:

providing a hollow connector having at least one electrical conductor positioned interior of the connector;

providing said hollow connector that is at least partially comprised of an elastic casing;

providing an electrical device having at least one electrode;

providing an opening in said hollow connector for receiving said electrical device into said hollow connector, whereby the elastic casing is stretched to accommodate said device; and inserting said implantable electrical device through said opening such that said at least one electrical conductor is urged against said at least one electrode by said stretched elastic casing.

15. The method of claim 14, wherein said step of providing the hollow connector having at least one electrical conductor positioned interior of the connector is further comprised of an electrical contact attached to said electrical conductor for contacting said at least one electrode.

16. The method of claim 14, wherein said step of providing said hollow connector is further comprised of selecting biocompatible materials for said connector.

17. The method of claim 14, wherein said step of providing said hollow connector that is at least partially comprised of an elastic casing is further comprised of providing at least one sealing ridge inside said hollow connector to seal against said electrical device.

* * * * *